United States Patent [19]

Agrawal et al.

[11] Patent Number: 4,705,548

[45] Date of Patent: Nov. 10, 1987

[54] LIQUID PRODUCTS USING AN AIR AND A NITROGEN RECYCLE LIQUEFIER

[75] Inventors: Rakesh Agrawal, Allentown; Steven R. Auvil, Macungie, both of Pa.

[73] Assignee: Air Products and Chemicals, Inc., Allentown, Pa.

[21] Appl. No.: 856,087

[22] Filed: Apr. 25, 1986

[51] Int. Cl.[4] ..... F25J 3/04

[52] U.S. Cl. ..... 62/22; 62/28; 62/38

[58] Field of Search ..... 62/18, 26, 28, 33, 38, 62/22

[56] References Cited

U.S. PATENT DOCUMENTS 3,605,422 9/1971 Pryor et al. ..... 62/13
4,152,130 5/1979 Theobald ..... 62/18
4,372,764 2/1983 Theobald ..... 62/38
4,375,367 3/1983 Prentice ..... 62/13
4,400,188 8/1983 Patel et al. ..... 62/13
4,464,188 8/1984 Agrawal et al. ..... 62/13

FOREIGN PATENT DOCUMENTS 1472402 5/1977 United Kingdom .

*Primary Examiner*—Ronald C. Capossela
*Attorney, Agent, or Firm*—G. L. Chase; J. C. Simmons; W. F. Marsh

[57] ABSTRACT

Liquid nitrogen, oxygen and/or argon are produced from a cryogenic distillative separation efficiently and economically using a combination of air recycle and nitrogen recycle to produce a liquid product.

19 Claims, 5 Drawing Figures

LIQUID PRODUCTS USING AN AIR AND A NITROGEN RECYCLE LIQUEFIER

TECHNICAL FIELD

The present invention is directed to producing liquefied nitrogen, oxygen and/or argon in a cryogenic distillative separation. More specifically, the present invention is directed to utilizing a combination of an air recycle and a recycled nitrogen stream to provide liquid product from a cryogenic distillative separation.

BACKGROUND OF THE PRIOR ART

Liquefied atmospheric gases, including nitrogen, oxygen and argon, are finding increasing uses in industry. Such liquefied atmospheric gases provide cryogenic capabilities for various industrial processes, are more economical to transport in merchant supply and provide ready and economical sources of gaseous product from liquid storage facilities. For instance, liquid nitrogen is increasingly used to freeze food products, to cryogenically embrittle used materials for cleaning or recycle, and as a supply of gaseous nitrogen inerting medium for various industrial processes.

The cost of liquefied atmospheric gases is generally a factor in comparing the use of gaseous product and liquid product. It is apparent that additional energy or power to produce the necessary refrigeration to derive liquid products from air makes a liquid generating process more energy intensive than the typical gaseous product process. Therefore, to meet the increasing needs for liquid product in the area of atmospheric gases, it is desirable to have a process which is energy efficient in operation and economical from a capital cost factor. The prior art has frequently suffered from either or both of these aspects of producing liquefied atmospheric gases.

British Pat. No. 1,472,402 discloses a cryogenic air separation cycle wherein gaseous nitrogen is removed from a column, is liquefied in a separate system and the liquid is recovered in part as product and a part as reflux for the column.

In U.S. Pat. No. 3,605,422 an air separation process is described wherein liquid oxygen and liquid nitrogen are derived directly from a distillation column. All of the feed air to the process enters the high pressure stage of the distillation column. In addition, the liquid nitrogen product of the process is entirely derived from the high pressure stage of the column. The process also utilizes a gaseous nitrogen recycle refrigeration system including an external refrigeration package to provide sufficient cryogenic temperatures to produce adequate reflux in the distillation column and liquid product. This process is capital intensive in that it must require external refrigeration which additionally increases power requirements. The liquid nitrogen produced in the nitrogen recycle of this patent is returned entirely to the distillation column for further rectification when liquid oxygen is the predominant product.

In U.S. Pat. No. 4,152,130, a process is set forth for the production of liquid nitrogen and liquid oxygen from a cryogenic distillative separation of air using a two-stage column and an air recycle refrigeration package. Nitrogen recovered as the gas from the distillation column is not passed through a recycle mode, but is rewarmed and vented or used for clean-up duty. The liquid atmospheric gas products are derived directly from the column, specifically as liquid nitrogen from the reboilercondenser of the high pressure stage of the column and liquid oxygen from the sump of the low pressure stage of the column. Accordingly, the entire removal of liquid nitrogen product directly from the column affects the quantity of reflux available to operate the rectification of the various stages of the column and increases the total air process requirements for that flowscheme.

In U.S. Pat. No. 4,375,367, an improved process derived from the previously discussed patent is set forth which requires less capital expenditure due to the reduction in the utilization of compressor-expander apparatus for the production of refrigeration. The cycle utilizes a recycle of a portion of the feed air, as well as a rewarming and introduction into the low pressure stage of a high pressure nitrogen gas product from the high pressure stage of the distillation column. However, the entire nitrogen liquid product is derived from the reboiler-condenser of the high pressure stage of the column, and again, the production of such liquid product will be affected by the limitations that the requirement for reflux dictate on the process.

In U.S. Pat. No. 4,400,188, a cryogenic system for the recovery of gaseous nitrogen is disclosed. A gaseous nitrogen recycle is utilized in which nitrogen is condensed at the base of a column, rather than at an intermediate level, and the resulting liquid is entirely utilized as internal reflux.

In U.S. Pat. No. 4,464,188, a nitrogen recycle and an air stream are used to reboil a distillation column and the resulting liquid nitrogen and liquid air are both fed entirely to the column as reflux and feed respectively. Gaseous nitrogen is produced by the process.

Various of the problems of capital intensity, energy demands and recoveries in cryogenic distillative separations for the production of liquid atmospheric gases are overcome by the present invention by the design and methods set forth below.

BRIEF SUMMARY OF THE INVENTION

The present invention involves a process for the cryogenic distillative separation of air by fractionation in a distillation column to produce at least one liquid product stream selected from the group consisting of liquid nitrogen, liquid oxygen and/or liquid argon, the improvement comprising: cooling a feed air stream by appropriate refrigeration to produce at least a portion of the feed air stream as a liquid air stream; introducing at least a portion of the liquid air stream to the distillation column as feed; producing a gaseous nitrogen stream from the distillation column and recycling at least a portion of the nitrogen stream to the process, preferably to provide refrigeration for the feed air; compressing the recycled nitrogen stream and reboiling a process stream with the recycle nitrogen stream to produce boil-up for the process and a condensed nitrogen stream and recovering at least a portion of the condensed recycle nitrogen as liquid nitrogen product.

Preferably the compressed recycle nitrogen either reboils the distillation column in an intermediate boiler-condenser or boils liquid feed air in a side boiler-condenser before feeding the air to the distillation column.

In a more specific embodiment of the invention characterized above, the present invention is directed to a process for the cryogenic distillative separation of air to produce at least a liquid nitrogen product comprising the steps of compressing feed air to an elevated pressure and removing water, carbon dioxide and condensibles from the feed air, splitting the feed air into a first split feed stream and a second split feed stream, cooling each split feed stream to a lower temperature by indirect heat exchange against process streams, expanding a first portion of the first split feed stream through a warm expander and recycling at least part of the expanded stream to the feed air while providing refrigeration to the feed air by indirect heat exchange, expanding the second split feed stream through a cold expander and introducing at least a first portion of the expanded stream into a distillation column, recycling a second portion of the expanded second split stream to the feed air while providing refrigeration to the feed air by indirect heat exchange, removing an oxygen-enriched stream from the base of the distillation column, removing a gaseous nitrogen stream from the distillation column and condensing at least a first portion of the gaseous nitrogen stream against an oxygen-enriched fluid of the distillation column to form a liquid nitrogen stream, removing a second gaseous nitrogen stream from the distillation column and recycling said stream in heat exchange against process streams to provide refrigeration for said process streams, recompressing the second gaseous nitrogen stream and liquefying said stream against process fluid of the distillation column to form a second liquid nitrogen stream and recovering at least a portion of the liquid nitrogen produced by heat exchange with the oxygen-enriched fluid and the process fluid as a liquid nitrogen product.

Preferably, the recompressed second gaseous nitrogen stream is liquefied in a boiler-condenser at an intermediate location in the low pressure stage of the distillation column. Alternately, the recompressed second gaseous nitrogen stream is liquefied in a side boiler-condenser outside the distillation column by heat exchange against a part of the second portion of the first split stream of the feed air.

Preferably, a liquid oxygen product is recovered from the sump of the low pressure stage of the distillation column as an oxygen-enriched stream.

Alternatively, an oxygen-enriched stream from the sump of the low pressure stage of the distillation column is indirectly heat exchanged against gaseous nitrogen from said low pressure stage in an overhead boiler-condenser to produce liquid nitrogen reflux and a gaseous oxygen-enriched stream.

Preferably the cryogenic separation is performed in a two pressure stage distillation column wherein the base of the low pressure stage is in indirect heat exchange communication with the top of the high pressure stage by means of a reboiler-condenser.

DETAILED DESCRIPTION OF THE INVENTIDN

Figure 1:
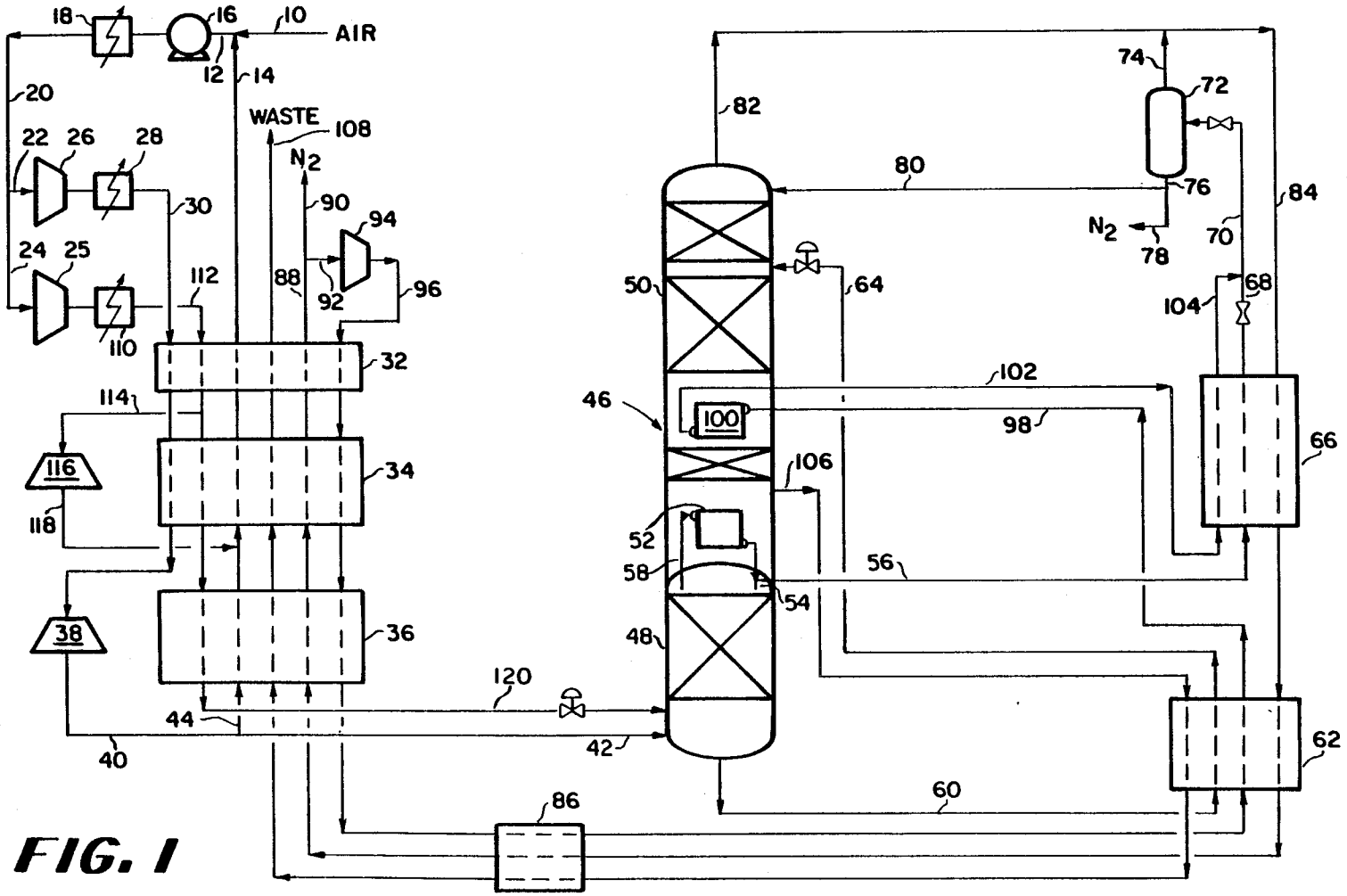
FIG. 1 is a schematic flowscheme of a preferred embodiment of the present invention showing air recycle and gaseous nitrogen recycle.

The present invention improves on cryogenic distillative separations of air to produce liquid products, particularly large volumes of liquid nitrogen products (or oxygen and argon) by combining air recycle features with a novel nitrogen recycle feature to effect greater recoveries of nitrogen from the air processed in the separation and by recovering that nitrogen (oxygen or argon) produced as a liquid product in a more efficient manner.

The air recycle involves the compression and cooling of feed air with subsequent expansion of the air to provide refrigeration wherein a portion of the expanded air providing refrigeration is recycled to feed air. The air recycle provides, in part, refrigeration necessary for cryogenic distillation and recovery of liquid products. In combination with the recycle of a portion of the feed air, the present invention recovers gaseous nitrogen from a distillation column and recycles the gaseous nitrogen to recover refrigeration before recompressing the nitrogen to a suitable pressure and cooling the repressurized gaseous nitrogen and liquefying it in heat exchange against liquid air or process fluid in the distillation column of the process to provide boil-up in the column and condensed nitrogen, which may be utilized at least in part as reflux and at least in part as liquid nitrogen product. The production of boil-up in the distillation column using the nitrogen recycle makes the distillation or fractionation more efficient. As a result, the recovery of liquid nitrogen product from such a recycle nitrogen flow-scheme is a more efficient production of liquid product than would be available directly from a distillation column. Total recovery of liquid nitrogen is limited in the prior art direct recovery from a distillation column, but is not so stringently limited in recovering liquid product from the nitrogen recycle flowpath of the present invention.

In a typical air recycle liquefier, all of the high pressure liquid air from the main heat exchangers is fed to a high pressure distillation column. Except for any flash, almost all of this liquid feed air leaves from the bottom of the distillation column is liquid rich in oxygen. This oxygen-rich liquid is subcooled and is fed to some intermediate tray in a low pressure column. In the low pressure column, this liquid travels downward and collects in the bottom or sump of the low pressure column. In order to carry out the distillation efficiently, the liquid in the sump of the low pressure column is boiled to provide vapor that ascends the column for rectification duty. When the nitrogen recycle feature of the present invention is not utilized, all of the required boil-up in the low pressure stage of the distillation column is achieved by condensing gaseous nitrogen from the top of the high pressure stage of the distillation column against oxygen-enriched liquid in the sump of the low pressure stage. A portion of this condensed nitrogen must be used to provide reflux to the distillation column and the rest of the condensed nitrogen can be produced as liquid nitrogen product. Normally, about more than half of the condensed nitrogen must be returned to the high pressure stage of the distillation column as reflux, therefore the amount of liquid nitrogen that can be produced as product is limited. As a result, if liquid nitrogen is the predominantly desired product and is produced from the top of a high pressure stage of a two-stage distillation column. the recovery of nitrogen, based on the air feed to the distillation column, is relatively low. At low recoveries, larger amounts of air must be processed to produce a given quantity of liquid nitrogen, which leads to higher power consumption and larger equipment sizes.

When the nitrogen recycle feature of the present invention is added to the air recycle feature previously known to provide the unique combination of the present invention, the required boil-up for the distillation column is more easily achieved and more nitrogen is condensed, resulting in the increase in the recovery of nitrogen (particularly liquid product) in a more efficient manner. With air recycle and nitrogen recycle used as in the present invention, a distillation column is capable of producing a significant fraction of its air feed as a gaseous nitrogen intermediate product which can be compressed, recycled and condensed to provide liquid nitrogen product and reflux for the distillation column. Since every mole of nitrogen used as liquid reflux produces a larger number of moles of gaseous nitrogen product (L/V in the top section of a distillation column is less than one), the overall recovery of nitrogen based on the air feed to the distillation column is increased. This increase in nitrogen recovery results in an increase in the efficiency of the distillative separation.

For example, if recycled nitrogen is used to provide boil-up in the low pressure stage of a distillation column, then it may not be required to be fed at the bottom of the low pressure stage of the distillation column, but may be suitably introduced into an intermediate level in the low pressure stage of the distillation column to make the distillation in this column more efficient. The intermediate level in the low pressure stage of the distillation column can be any level above the bottom-most reboiler-condenser. In this mode of operation, the amount of liquid in the bottom sump of the low pressure stage of the distillation column is decreased. This decreases the boil-up needed from the high pressure column and therefore the gaseous air fed to the high pressure column is also reduced. This leads to a significant reduction in size of the high pressure column. Unlike gaseous nitrogen from the high pressure column, the recycled gaseous nitrogen does not have to provide boil-up of the liquid richest in oxygen to the low pressure column. Consequently, the pressure of the recycled gaseous nitrogen is less than the pressure of the feed air to the high pressure column. This attribute contributes to a reduction in the power consumption when employing the nitrogen recycle and air recycle combination of the present invention in a cryogenic distillative separation.

As a result, the addition of nitrogen recycle to air recycle in a cryogenic distillative separation, increases the recovery of nitrogen from the cycle. This decreases the flow of air through the various pieces of equipment in the process and increases the pressure of the discharge of the main air compressor for the process. These factors not only decrease the power consumed, but also decrease equipment sizes and lead to some capital savings. Therefore, the combination of air and nitrogen recycle in a cryogenic distillative separation give high nitrogen recovery, result in less power demand and reduce the size of critical equipment components of the process. The greater nitrogen recovery allows flexibility to adjust the relative production of liquid nitrogen, liquid oxygen and liquid or gaseous argon from such a liquid producing cryogenic distillative separation.

Having discussed the general principals of the present invention, the air and nitrogen recycle cryogenic distillative separation will now be described in greater detail with reference to several specific and preferred embodiments.

With reference to FIG 1, a preferred embodiment of the present invention is set forth using air recycle and nitrogen recycle in a two-stage cryogenic distillation column. Compressed air at about 68 psia, after being cleaned of water, carbon dioxide and condensibles preferably in a molecular sieve adsorption unit (not shown), is introduced in line 10 into the system and combined with a recycle stream in line 14. The combined stream in line 12 is compressed to elevated pressure in compressor 16 and aftercooled in aftercooling heat exchanger 18 against external cooling fluid. The resulting stream in line 20 is at a pressure of 450 psia and a temperature of 95° F. The stream in line 20 is split into a first split stream in line 24 and a second split stream in line 22. The first split stream in line 24 is compressed to a further elevated pressure in compressor 25 and aftercooled in aftercooling heat exchanger 110. The stream in line 112 is at a pressure of approximately 622 psia and is cooled in a warm stage 32 of a main heat exchanger before being split into a first portion 114 of the first split feed stream in line 112 which portion is expanded in an expansion turbine 116 to a lower pressure and temperature in line 118 of approximately 66 psia and −158° F. This stream is returned through an intermediate stage 34 of the main heat exchanger and the warm stage 32 of the main heat exchanger in combination with the recycle stream in line 14. The second portion of the first spilt feed stream passes through the intermediate stage 34 and the cold stage 36 of the main heat exchanger and is introduced in line 120 into the high pressure stage 48 of a two-stage distillation column 46. The stream in line 120 is at a pressure of approximately 613 psia and a temperature of −275° F.

The second split feed stream in line 22 is further compressed in compressor 26 and aftercooled in aftercooling heat exchanger 28 to result in a stream in line 30 at approximately 650 psia and a temperature of 95° F. This stream in line 30 is then cooled through the warm and intermediate stages 32 and 34, respectively, of the main heat exchanger, before being expanded in expansion turbine 38 to a pressure of 67 psia and a temperature of approximately −280° F. in line 40. A first portion of the stream in line 40 is introduced into the distillation column in line 42, specifically at the high pressure stage 48 of the column 46. A second portion 44 of the second split feed stream is recycled through each stage of the main heat exchanger and is returned to feed air in line 14. This treatment of the two split streams 22 and 24 constitute an appropriate refrigeration scheme for the feed air, but other refrigeration schemes could be used in whole or in part such as external refrigeration with a closed cycle refrigerant.

In the high pressure stage 48 of the distillation column 46, the feed air is rectified into a first gaseous nitrogen fluid that migrates to the top of the stage and a liquid oxygen fluid which drains to the bottom of the stage. The gaseous nitrogen is removed in line 58 and passes through a reboiler-condenser 52 which heat exchanges the gaseous nitrogen against liquid oxygen-enriched fluid in the low pressure stage 50 of the distillation column 46. This results in the condensation of the gaseous nitrogen and the vaporization of the oxygen-enriched liquid. A portion of the condensed liquid nitrogen is returned in line 54 to the high pressure stage 48 as reflux for the rectification occurring therein. A second portion of the liquid nitrogen is removed in line 56 and is subcooled in subcooling heat exchanger 66. The stream now in line 68 is combined with another, at least partially liquefied, nitrogen stream in line 104 and the combined, at least partially liquid, nitrogen stream in line 70 is introduced at reduced pressure into a phase separator 72 to produce liquid nitrogen in line 76 and gaseous nitrogen in line 74. At least a portion of the liquid nitrogen in line 76 is recovered as liquid nitrogen product in line 78. Another portion of the liquid nitrogen in line 76 is introduced in line 80 into the overhead of the low pressure stage 50 of the distillation column 46 as reflux.

The liquid oxygen-enriched fluid in the base of the high pressure stage 48 of the distillation column 46 is removed in line 60, is cooled in subcooling heat exchanger 62 and then is introduced into the low pressure stage 50 of the distillation column 46 in line 64.

The streams in line 80 and in line 64 are distilled in the low pressure stage 50 of the distillation column 46 at a pressure of approximately 22 psia. A second gaseous nitrogen stream is removed from the overhead of the low pressure stage 50 in line 82 at a pressure of 20 psia and a temperature of −315° F. This gaseous nitrogen is combined with gaseous nitrogen from line 74 and the combined streams in line 84 are rewarmed to provide refrigeration in subcooling heat exchangers 66 and 62 and further in heat exchanger 86 before being additionally rewarmed to provide refrigeration to the feed air through the three stages of the main heat exchanger 36, 34 and 32, respectively. The gaseous nitrogen is rewarmed in line 88 to a near ambient temperature, and a portion of the gaseous nitrogen can be removed in line 90 as product at a pressure of approximately 16 psia. Another portion of the gaseous nitrogen is recycled in line 92 and recompressed in compressor 94 to a pressure of approximately 56 psia. This pressure is well below the feed pressure of approximately 66 psia of the feed air to the high pressure stage 48 of the distillation column 46. The recompressed and recycled gaseous nitrogen in line 96 is then recooled in the main heat exchanger in stages 32, 34 and 36, as well as the heat exchanger 86 and the subcooling heat exchanger 62. The cooled nitrogen recycle in line 98 is then condensed and liquefied in an intermediate boiler-condenser 100 which is situated at an intermediate level of the low pressure stage 50 of the two pressure stage distillation column 46 wherein it provides suitable boil-up for the intermediate stage of that low pressure stage of the distillation column 46. The resulting condensed nitrogen recycle stream in line 102 is further cooled in subcooling heat exchanger 66 and combined as stream 104 with the liquid nitrogen stream 68 from the high pressure stage 48 of the distillation column 46. These combined streams in line 70, as stated previously, provide the liquid nitrogen product in line 78, the nitrogen liquid reflux for the low pressure stage 50 in line 80 and a portion of the vaporous nitrogen recycle in line 74. Alternatively to recycling stream 84 to exchangers 36, 34 and 32, stream 84 can be cold compressed and fed directly to the boiler-condenser 100. This is not shown.

An oxygen-enriched stream is removed is line 106 from the low pressure stage 50 of the distillation column 46 and is rewarmed through the various heat exchanger stages and removed as a waste stream in line 108. The liquid nitrogen product in line 78 is recovered at a pressure of approximately 20 psia and a temperature of −315° F. By utilizing a nitrogen recycle, as well as an air recycle, to provide refrigeration duty for the cryogenic separation set forth in FIG. 1, the required refrigeration necessary for recovery of liquid products is achieved and is achieved efficiently by the heat exchange of the nitrogen recycle at an intermediate stage of the low pressure stage 50 of the distillation column 46 wherein the composition of the fluid in the column which the recycle nitrogen is heat exchanging against is such that the pressure of the recycling nitrogen can be reduced from the pressure of feed air requirements to the distillation column. Additionally, because at least a portion of the liquid nitrogen product from the overall process is formed from the nitrogen recycle stream, the total liquid nitrogen recovery is high. The nitrogen recycle, when condensed to form liquid nitrogen product, avoids a requirement to recover all of the liquid nitrogen product from the reflux which the column is producing for the rectification and separation of nitrogen from oxygen. Because some of the boil-up for the low pressure stage 50 of the distillation column 46 is produced at the intermediate boiler-condenser 100, not as much oxygen-enriched liquid must be boiled at the sump of the low pressure stage 50 of the distillation column 46. This results in the flow of the feed to the high pressure stage 48 of the distillation column being reduced from what it would have been without the intermediate boiler-condenser 100. As a result, the power requirements of the process are reduced, because feed air flow can be reduced, and power requirements are also reduced because the recycle nitrogen does not have to be compressed up to feed air conditions. With the recovery of nitrogen from the recycle stream condensed in the low pressure stage 50, as well as from liquid nitrogen produced from the high pressure stage, the nitrogen recoveries as liquid product are increased without detrimentally affecting the rectification requirements in either stage of the distillation column. Therefore, total nitrogen recoveries are higher, and for a given nitrogen liquid product production, the amount of air processed can be reduced. A reduction in total air processed results in a reduction in power requirements and a reduction in the size of all process equipment, such that capital savings as well as power savings are achieved.

For example, the higher recoveries of nitrogen increases the pressure of air in line 10 and this coupled with the decrease in flow-rate of this stream reduces the power requirement and size of the molesieve adsorption unit and chiller, not shown, used to remove carbon dioxide, water and other condensibles.

Figure 2:
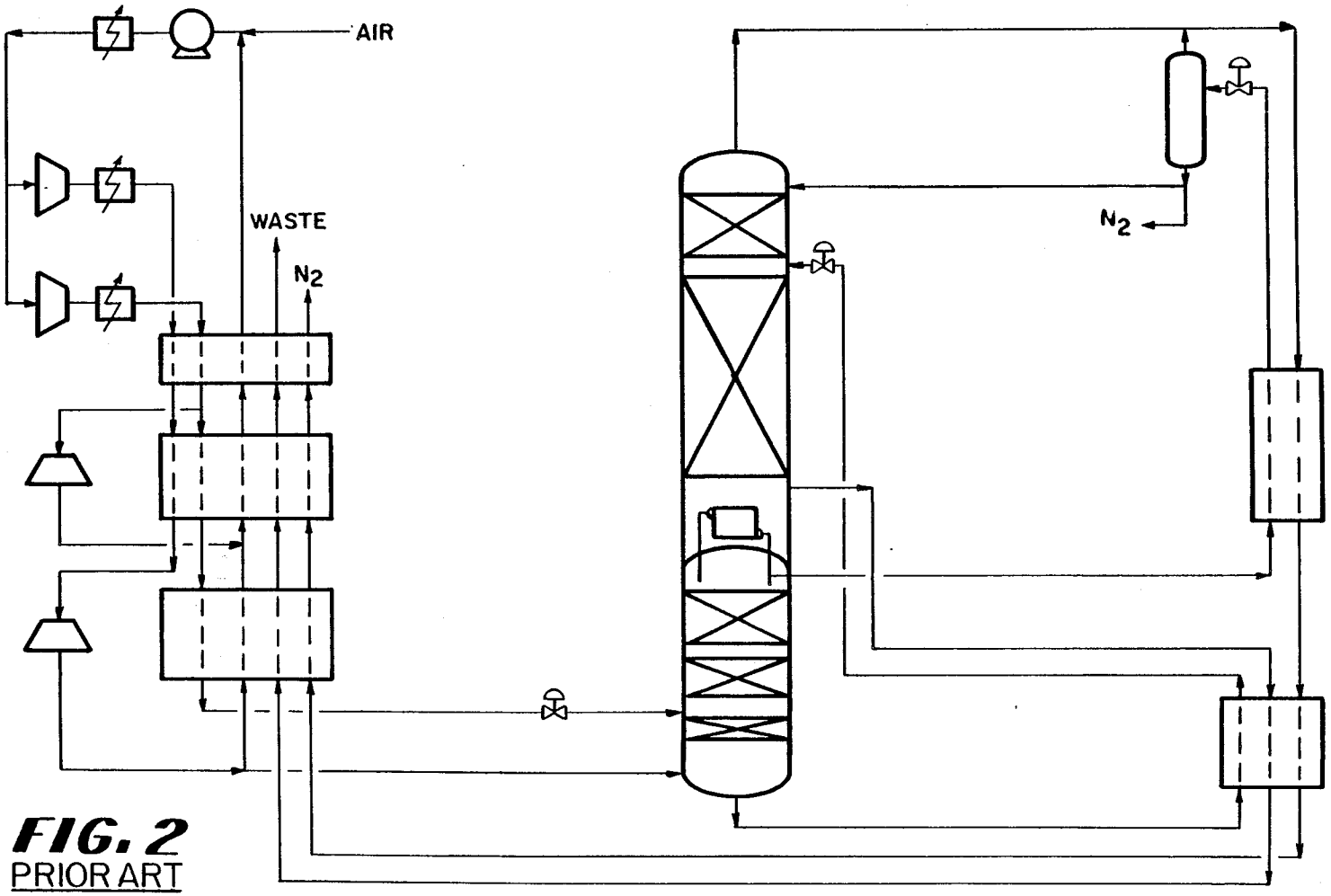
FIG. 2 PRIOR ART
FIG. 2 is a schematic flowscheme of the prior art as exemplified by U.S. Pat. No. 4,152,130.

This embodiment of the present invention set forth in FIG. 1 is contrasted against the prior art as set forth in FIG. 2 which does not utilize a nitrogen recycle or an intermediate boiler-condenser to combine to make liquid nitrogen product. The prior art flowscheme set forth in FIG. 2 is representative of the cycle shown in prior art U.S. Pat. No. 4,152,130 with the exception that liquid oxygen recovery is not illustrated in FIG. 2. A comparison of the nitrogen recovery and power requirements of the present invention as illustrated in FIG. 1 and the prior art as illustrated in FIG. 2 is set forth in Table 1 below. As can be appreciated, the present invention exhibits a nitrogen recovery based upper the nitrogen in the total air feed to the distillation column of 80% while the prior art exhibits a recovery of only 51%. In achieving this increased nitrogen recovery, the present invention utilizes a power which is about 96% of the power required of the prior art which is equivalent to a little more than 4% power savings to produce the same quantity of products. This is deemed to exemplify an unexpected result in improvement in the present invention over that of the prior art.

TABLE 1

Total Nitrogen Recovery and Relative Power Breakdown for 74 T/D of LIN and 24 T/D of GAN Production

| | Process According to U.S. Pat. No. 4,152,130 FIG. 2 | Process Employing the Air/$N_2$-Recycle Liquifier Concept FIG. 1 |
|---|---|---|
| Nitrogen Recovery | 51 | 80 |
| Power Breakdown: | | |
| Main Air Compressor | 0.235 | 0.172 |
| Recycle Air Compressor | 0.768 | 0.737 |
| Recycle Nitrogen Compressor | — | 0.070 |
| Molesieve/Precooler Power | 0.040 | 0.021 |
| Total Power (KW) | 1.043 | 1.000 |

Further embodiments of the present invention will now be disclosed wherein the distinction from the preferred embodiment as set forth in FIG. 1 will be illustrated in bold face in the drawings and a description of these alterations from the base flowscheme will be the only sections of the embodiments fully described. These alternative embodiments illustrate that the general principles of the present invention can be applied to various specific distillation schemes.

Figure 3:
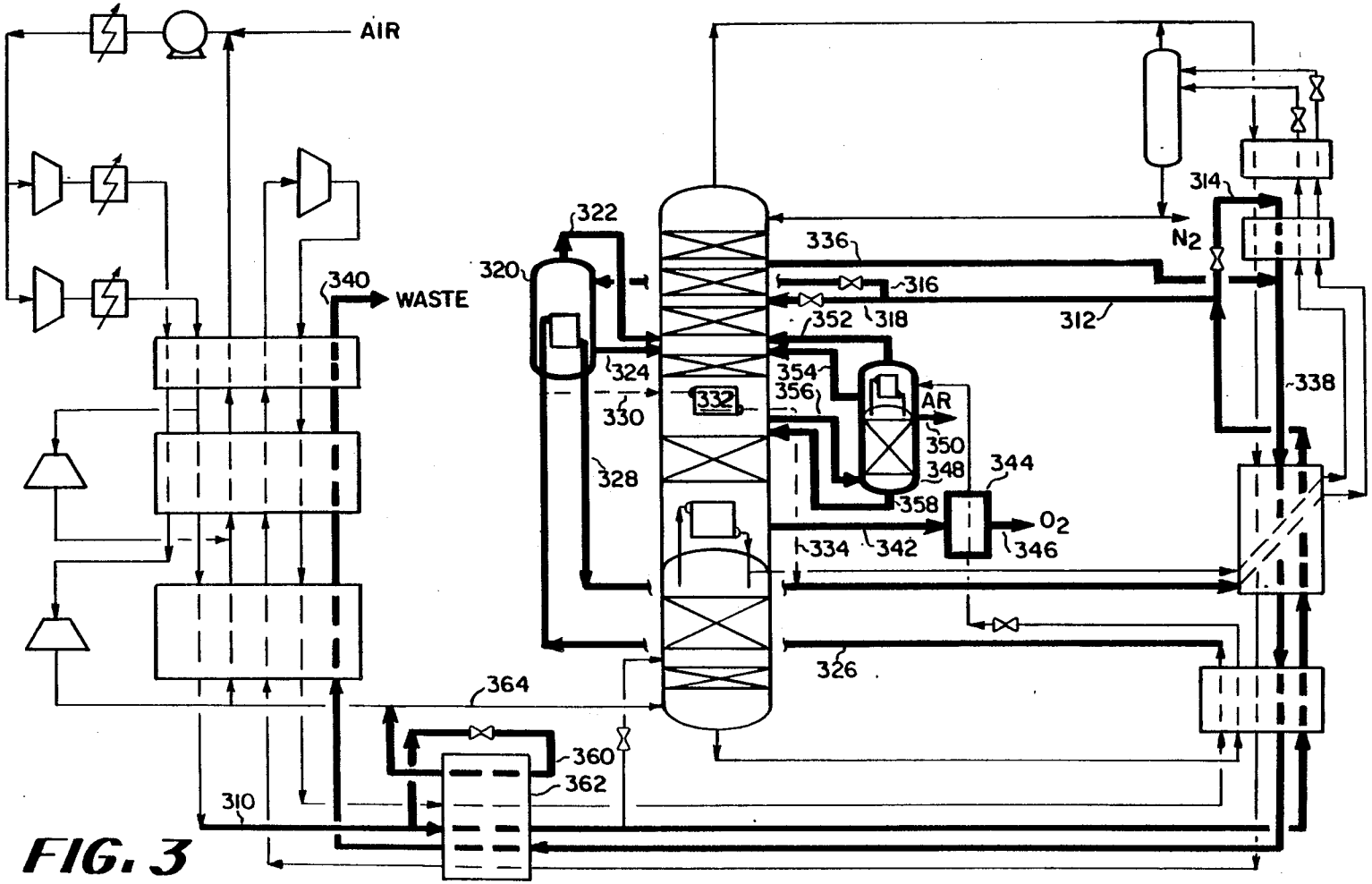
FIG. 3 is a schematic flowscheme of the alternate embodiment of the present invention showing side boiler-condenser duty and liquid argon recovery.

In FIG. 3, another embodiment of the present invention is set forth in a two pressure stage distillation column wherein a liquid argon side column 348 is illustrated and the nitrogen recycle can be heat exchanged either against liquid air in the side boiler-condenser 320 or an intermediate boiler-condenser 332 which condenses the nitrogen recycle against a low pressure stage distillation column process fluid. The second portion of the first split feed stream in line 310 is cooled in subcoolers and a portion of that stream in line 314 is returned for subcooling duty against liquid nitrogen product. The remaining part of the stream in line 312 is fed in part to the low pressure stage of the distillation column in line 318 and another part in line 316 is introduced into the side boiler-condenser 320. This liquid feed air is boiled against condensing recycle nitrogen from line 326 which is introduced into the heat exchanger of the boiler-condenser 320 and is condensed and removed in line 328 before being combined with other nitrogen to form nitrogen liquid product. A portion of the liquid air is introduced into the low pressure stage of the distillation column as liquid in line 324, while vaporized liquid air is returned in line 322 to the low pressure stage of the distillation column. A waste stream is removed in line 336 and combined with the recycling rewarming liquid air in line 314 to produce a stream in line 338, which is completely rewarmed and vented in line 340. Argon can be recovered in line 350 from a side-arm distillation column 348 by introducing a fluid feed stream in line 356 from the low pressure stage of the distillation column into the side column 348 and returning the liquid stream in line 358 to the low pressure stage of the main column. An oxygen-rich stream from the base of the high pressure stage of the distillation column condenses an overhead reflux in a boiler-condenser in the side column 348 for argon production, and the oxygen-rich stream can be separately introduced into the low pressure stage of the distillation column after its condensing duty as a vapor in line 352 and a liquid in line 354. Additionally, liquid oxygen can be recovered from the low pressure stage of the main distillation column in line 342 and subcooled in subcooling heat exchanger 344 to provide liquid oxygen product in line 346. As stated earlier, rather than condense the recycling nitrogen in a side boiler-condenser 320 against liquid air feed, the embodiment in FIG. 3 can be altered to condense the recycling nitrogen in line 330 against process fluid in the low pressure stage of the distillation column in the optional boiler-condenser 332 and the liquid nitrogen resulting therefrom is returned in line 334 to the subcooling heat exchangers to be combined with liquid nitrogen produced from the high pressure stage of the main distillation column and a portion as liquid nitrogen product and reflux for the low pressure stage of the distillation column. A part of the liquid air feed comprising the second portion of the first spilt stream in line 310 is expanded in line 360, rewarmed in exchanger 362 and combined with air feed comprising the first portion of the second spilt stream in line 364 as feed to the high pressure stage of the column. Other portions of this embodiment set forth in FIG. 3 will not be described because they are essentially the same as that in FIG. 1. The significant distinctions in the cycle of FIG. 3 over that of FIG. 1 are: that the nitrogen recycle is condensed against liquid feed air in a side boiler-condenser, rather than a process fluid of the distillation column; that argon recovery is accomplished; and that at least a portion of the liquid air is expanded, rewarmed and combined with the other split air to feed the column.

Figure 4:
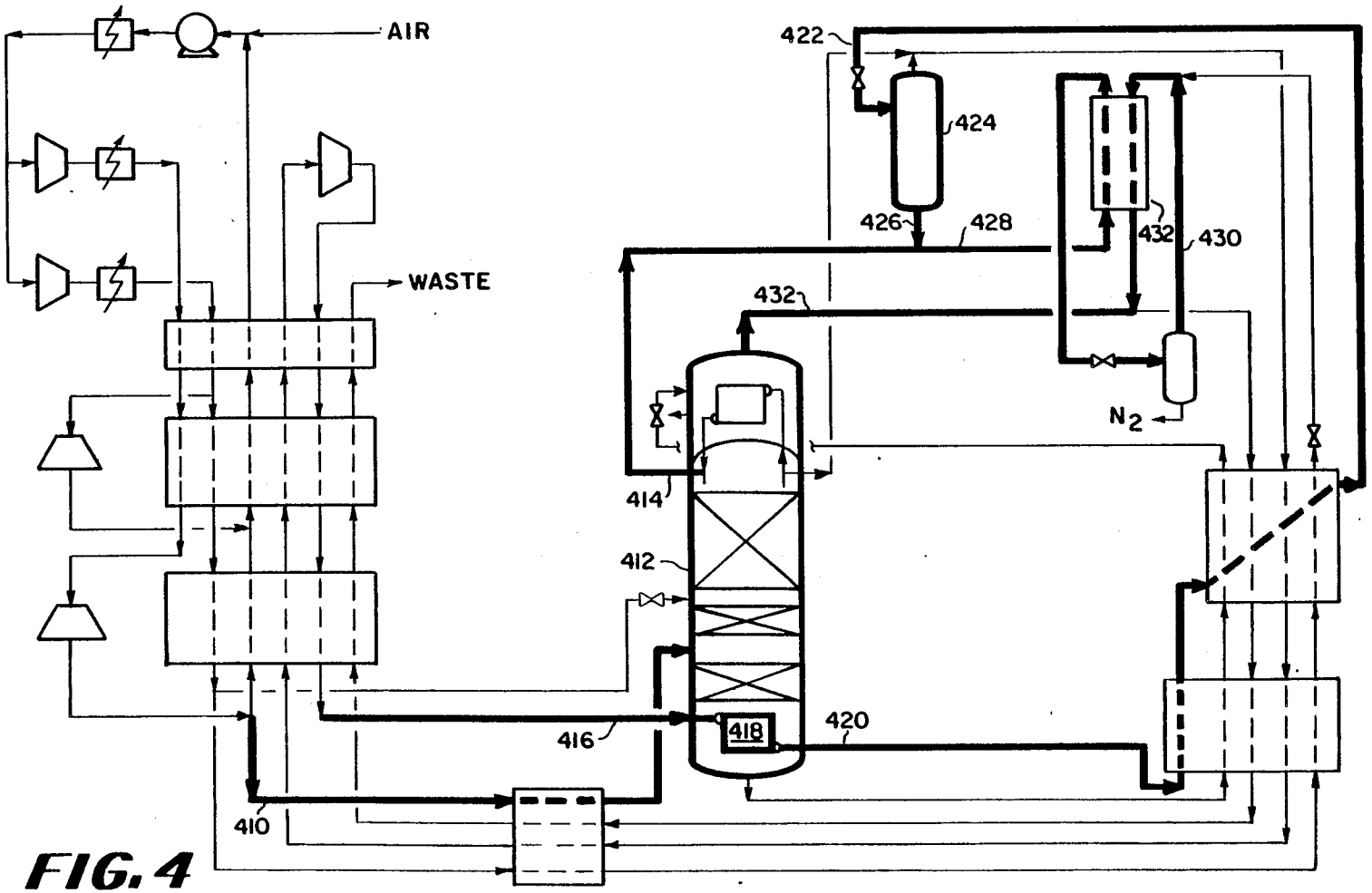
FIG. 4 is a schematic flowscheme of a single stage distillation column embodiment of the present invention.

Another embodiment of the present invention is set forth at FIG. 4 which again will be described only with regard to those portions of the flowscheme which differ from the embodiment fully described in FIG. 1. In this embodiment, a single stage distillation column 412 is utilized to perform the distillative separation of nitrogen from oxygen. A portion of the second split feed stream in line 410 is introduced into the distillation column 412. This feed is distilled in the column 412 to produce an oxygen-enriched liquid in the sump of the distillation column and a gaseous nitrogen fluid in the top of the distillation column. Nitrogen is condensed in the overhead boiler-condenser and the liquid nitrogen is returned for reflux duty to the distillation column. A portion of the liquid nitrogen is removed in line 414 and can be recovered along with liquid nitrogen from the recycle in line 426 as a combined liquid nitrogen in line 428 (depending on the recycle flow of nitrogen, the flow in line 414 could be reversed and therefore constitute reflux into the column). The liquid nitrogen in line 428 is subcooled in a subcooling heat exchanger against feed air comprising a part of the second portion of the first split stream and is reduced in pressure and phase separated to perform a separation of liquid nitrogen product and gaseous nitrogen which is rewarmed as a waste stream which is vented from the process. The nitrogen recycle stream comprising the recompressed second gaseous nitrogen stream in line 416 is condensed in a boiler-condenser 418 in the sump of the single stage distillation column and the liquid nitrogen produced therefrom in line 420 is subcooled in subcooling heat exchangers and introduced into a phase separator 424 through line 422. The liquid nitrogen is removed in line 426 and forms a portion of the liquid nitrogen product produced from the process. The remaining process streams are similar to that of FIG. 1 and will not further be described. The result of this embodiment is to show that the air recycle and nitrogen recycle concept of the present invention can be utilized in a single stage distillation column wherein a portion of the liquid air is used to subcool the produced liquid nitrogen to diminish flashing when the pressure of the liquid nitrogen is reduced to provide the liquid nitrogen product.

Figure 5:
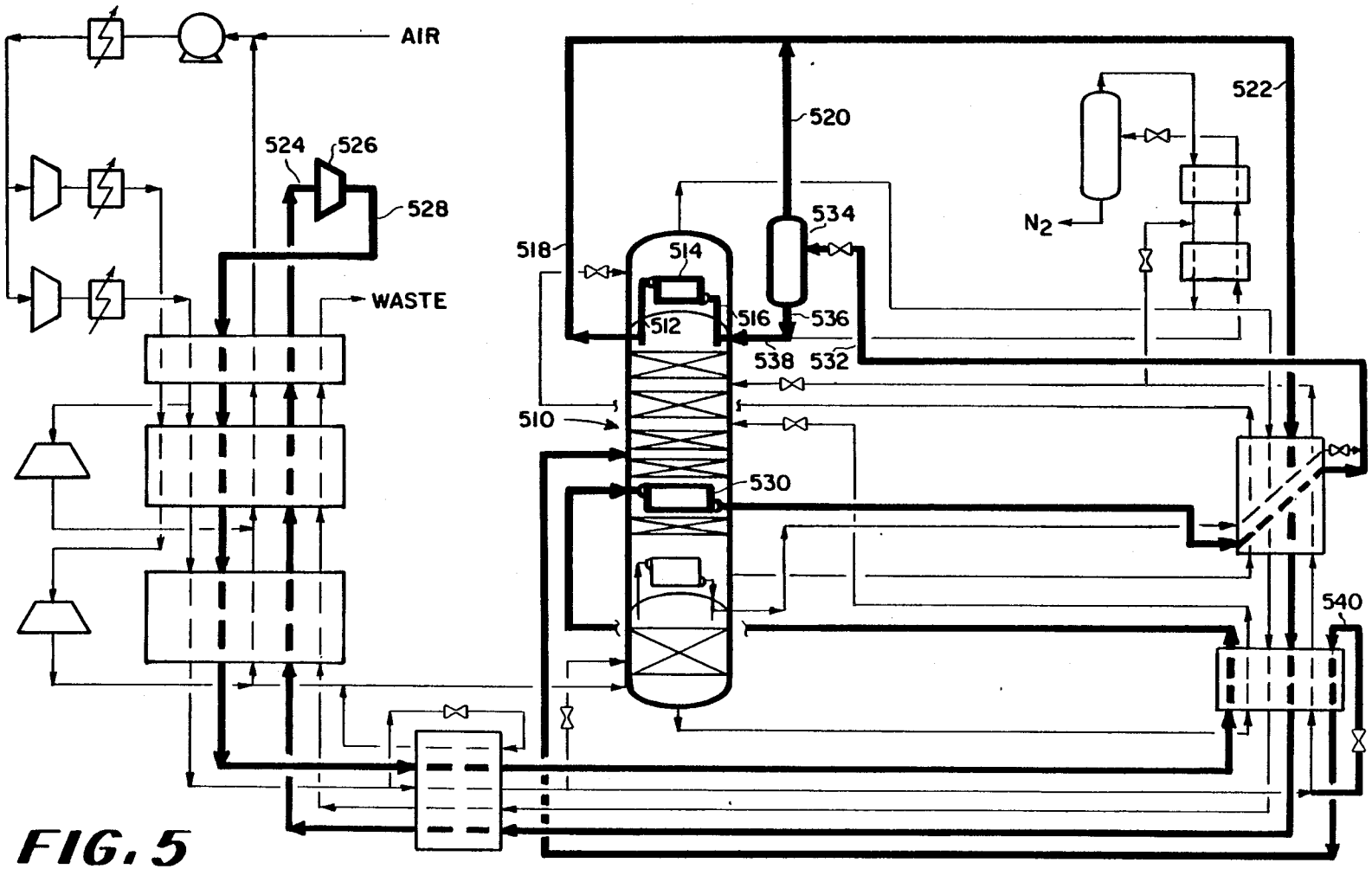
FIG. 5 is a schematic flowscheme of an alternate embodiment of the present invention utilizing an overhead boiler-condenser.

Yet another embodiment of the present invention is set forth in FIG. 5. As with the earlier embodiments, the embodiment of FIG. 5 will be described only with reference to the changes illustrated in bold line from that of the preferred embodiment of FIG. 1. In the embodiment of FIG. 5, a two stage distillation column 510 is utilized wherein each stage has an overhead boiler-condenser to provide reflux in part to the respective rectification portions of each stage. In the low pressure stage, gaseous nitrogen is removed in line 512 to be condensed against an oxygen enriched stream from the sump of the low pressure stage in a boiler-condenser 514 which returns liquid nitrogen to the rectification zone in line 516 and a gaseous oxygen-enriched stream. A portion of the produced gaseous nitrogen is removed in line 518 and combined with nitrogen in line 520 to result in a nitrogen recycle stream in line 522 which is rewarmed through various subcooling heat exchangers and the various stages of the main heat exchanger. The recycled nitrogen, now in line 524 is recompressed in recycle compressor 526, and the elevated pressure nitrogen recycle in line 528 is cooled through the various heat exchangers of the process before being condensed at an intermediate level of the low pressure stage of the distillation column in a boiler-condenser 530 against process fluids in that stage of the column. The resulting liquid nitrogen in line 532 is flashed and then phase separated in phase separator 534 into a recycle nitrogen gas in line 520 and a liquid nitrogen stream in line 536 a portion of which is returned to the column in line 538 as reflux for the process (depending on the flow of the recycle nitrogen stream, the flow in line 538 could be directed out of the column) and the remainder of which is subcooled against itself and feed air to produce the liquid nitrogen product as previously set forth in the other embodiments. A part of the liquid feed air in the second portion of the first split stream line 540 is expanded, rewarmed and introduced into the low pressure stage of the distillation column as feed.

The present invention has been set forth in a preferred embodiment and in various alternate embodiments to fully describe the invention and the achievements of efficiency, capital cost reduction and overall nitrogen recovery gains that the present invention exhibits against the prior art. In addition to producing large volumes of liquid nitrogen product beyond what is traditionally available from recovering liquid nitrogen directly from the distillation column or in capital intensive separate liquefaction stages, the present invention also can produce liquid oxygen and liquid argon as set forth in various of the embodiments.

Accordingly, the present invention should not be limited to those specific descriptions of the various embodiments, but the scope of the invention should be ascertained from the claims which follow.

We claim:

1. In a process for the cryogenic distillative separation of air by fractionation in a distillation column to produce at least one liquid product stream selected from the group consisting of liquid nitrogen, liquid oxygen and/or liquid argon, the improvement comprising:

(a) cooling a feed air stream by appropriate refrigeration to produce at least a portion of the feed air stream as a liquid air stream;

(b) introducing at least a portion of the liquid air stream to the distillation column as feed;

(c) producing a gaseous nitrogen stream from the distillation column and recycling at least a portion of said nitrogen stream to the process;

(d) compressing the recycled nitrogen stream and reboiling a process stream with the recycle nitrogen stream to produce boil-up for the process and a condensed nitrogen stream, and (e) recovering at least a portion of the condensed recycle nitrogen as liquid nitrogen product.

2. The process of claim 1 wherein a portion of the condensed recycle nitrogen is introduced into the distillation column as reflux.

3. The process of claim 1 wherein the compressed recycle nitrogen stream provides boil-up for a portion of the distillation column.

4. The process of claim 1 wherein the compressed recycle nitrogen stream boils a liquid feed air to the distillation column.

5. The process of claim 1 wherein at least a portion of the nitrogen streams of step (c) is recycled to provide refrigeration for the feed stream(s) before compressing it.

6. A process for the cryogenic distillative separation of air to produce at least a liquid nitrogen product, comprising the steps of:

(a) compressing feed air to an elevated pressure and removing water, carbon dioxide and condensibles from the feed air;

(b) splitting the feed air into a first split feed stream and a second split feed stream;

(c) cooling each split feed stream to a lower temperature by indirect heat exchange against process streams;

(d) expanding a first portion of the first split feed stream through a warm expander and recycling at least a part of the expanded stream to the feed air while providing refrigeration to the feed air by indirect heat exchange;

(e) expanding the second split feed stream through a cold expander and using at least a first portion of the expanded stream for a distillation step;

(f) recycling a second portion of the expanded second split stream to the feed air while providing refrigeration to the feed air by indirect heat exchange;

(g) removing an oxygen-enriched stream from the base of the distillation column;

(h) removing a gaseous nitrogen stream from the distillation column and condensing at least a first portion of the gaseous nitrogen stream against a fluid of the distillation column to form a liquid nitrogen stream;

(i) removing a second gaseous nitrogen stream from the distillation column and recycling said stream in heat exchange against process streams;

(j) recompressing the second gaseous nitrogen stream and liquefying said stream against process fluid of the distillation column to form a second liquid nitrogen stream; and (k) recovering at least a portion of the liquid nitrogen of step (h) and/or step (j) as a liquid nitrogen product.

7. The process of claim 6 wherein the distillation column has a high pressure stage and a low pressure stage.

8. The process of claim 7 wherein nitrogen gas from the high pressure stage is condensed against oxygen-enriched fluid in the low pressure stage by indirect heat exchange.

9. The process of claim 7 wherein a gaseous nitrogen product is recovered from the low pressure stage of the distillation column.

10. The process of claim 7 wherein an oxygen enriched stream from the sump of the low pressure stage of the distillation column is indirectly heat exchanged against gaseous nitrogen from said low pressure stage in a boiler-condenser to produce liquid nitrogen and a gaseous oxygen-enriched stream.

11. The process of claim 7 wherein an oxygen-enriched stream is removed from the base of the high pressure stage of the distillation column and is boiled in a boiler-condenser of a side-arm column to provide reflux in said column which produces argon from a fluid feed from the low pressure stage of the distillation column.

12. The process of claim 6 wherein the liquid nitrogen stream of step (h) and the second liquid nitrogen stream of step (j) are combined, phase separated and at least a portion of the liquid phase is recovered as liquid nitrogen product.

13. The process of claim 6 wherein the recompressed second gaseous nitrogen stream of step (j) is liquefied in a boiler-condenser in the low pressure stage of a two pressure stage distillation column.

14. The process of claim 6 wherein the recompressed second gaseous nitrogen stream of step (j) is liquefied in a side boiler-condenser by heat exchange against a part of the second portion of the first split stream of the feed air.

15. The process of claim 6 wherein an oxygen enriched stream is removed from the low pressure stage of the distillation column.

16. The process of claim 15 wherein a liquid oxygen product is recovered from the sump of the low pressure stage of the distillation column as the oxygen enriched stream.

17. The process of claim 6 wherein a part of the second portion of the first split stream is expanded and rewarmed in a subcooling heat exchanger and combined with the first portion of the second split stream and the combined streams are introduced into the distillation column.

18. The process of claim 6 wherein at least a portion of the liquid nitrogen from the distillation column is subcooled in a subcooling heat exchanger against a part of the second portion of the first split stream, the subcooled nitrogen stream is reduced in pressure and at least a portion of the stream is recovered as liquid nitrogen product.

19. The process of claim 6 wherein the recompressed second gaseous nitrogen stream of step (j) is liquefied in a boiler-condenser in the sump of a single stage distillation column.

* * * * *